US006769296B2

(12) United States Patent
Montalvo et al.

(10) Patent No.: US 6,769,296 B2
(45) Date of Patent: Aug. 3, 2004

(54) APPARATUS AND METHOD FOR MEASURING FORMATION PRESSURE USING A NOZZLE

(75) Inventors: Laura A. Montalvo, San Francisco, CA (US); Andrew L. Kurkjian, Sugar Land, TX (US); Robert Wayne Sundquist, The Woodlands, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 10/109,414

(22) Filed: Mar. 28, 2002

(65) Prior Publication Data

US 2002/0189339 A1 Dec. 19, 2002

Related U.S. Application Data

(60) Provisional application No. 60/298,164, filed on Jun. 13, 2001.

(51) Int. Cl.[7] ..... E21B 49/10; E21B 49/00

(52) U.S. Cl. ..... 73/152.51; 72/152.22; 72/152.26; 72/152.27

(58) Field of Search ..... 73/152.25–152.27, 73/152.51, 152.01, 152.41, 152.22, 152.29, 152.36; 166/55

(56) References Cited

U.S. PATENT DOCUMENTS

| | | | | |
|---|---|---|---|---|
| 2,747,401 A | | 5/1956 | Doll | |
| 4,745,802 A | * | 5/1988 | Purfurst | 73/152.26 |
| 4,843,878 A | | 7/1989 | Purfurst et al. | |
| 4,936,139 A | | 6/1990 | Zimmerman et al. | |
| 4,951,749 A | | 8/1990 | Carroll | |
| 5,065,619 A | | 11/1991 | Myska | |
| 5,230,244 A | | 7/1993 | Gilbert | |
| 5,777,242 A | | 7/1998 | Zuidberg et al. | |
| 5,969,241 A | | 10/1999 | Auzerais | |
| 6,164,126 A | * | 12/2000 | Ciglenec et al. | 73/152.01 |
| 6,223,822 B1 | | 5/2001 | Jones | |
| 6,230,557 B1 | * | 5/2001 | Ciglenec et al. | 73/152.01 |
| 6,301,959 B1 | | 10/2001 | Hrametz et al. | |
| 6,467,387 B1 | * | 10/2002 | Espinosa et al. | 89/1.15 |
| 6,658,930 B2 | * | 12/2003 | Abbas | 73/152.26 |

FOREIGN PATENT DOCUMENTS

| | | | | |
|---|---|---|---|---|
| CA | 2355549 | * | 2/2002 | E21B/47/00 |
| EP | 978630 | * | 2/2000 | E21B/49/10 |
| EP | 984135 | * | 3/2000 | E21B/49/08 |
| EP | 994238 | * | 4/2000 | E21B/49/00 |
| GB | 2 250 826 | | 6/1992 | |

OTHER PUBLICATIONS

Halliburton, "Petrotech® Knowledge" Info No. 2208, Entitled Pressure Compensated Chamber (PCC).

* cited by examiner

*Primary Examiner*—Thomas P. Noland
(74) *Attorney, Agent, or Firm*—J.L. Jennie Salazar; Brigitte L. Jeffery; John Ryberg

(57) ABSTRACT

A method for measuring a downhole formation pressure is disclosed which includes lowering a formation testing tool to a desired measuring position in a well borehole. Then a nozzle in the tool is extended so that the nozzle extends through the mud cake layer on a surface of a formation, forming a seal between the mud cake layer and a sealing surface of the nozzle. In an embodiment of the invention, the nozzle has a porous tip that extends into the invaded zone beyond the mudcake layer and is exposed to the formation pressure. In an alternate embodiment, the nozzle has a retractable tip that retracts into the nozzle. The nozzle and retractable tip are positioned in the mudcake and the retractable tip is retracted into the nozzle. The formation pressure is then communicated through the nozzle to a pressure sensor operatively connected to the nozzle.

36 Claims, 5 Drawing Sheets

APPARATUS AND METHOD FOR MEASURING FORMATION PRESSURE USING A NOZZLE

CROSS-REFERENCE TO RELATED APPLICATIONS

This application claims priority from Provisional Application No. 60/298,164, filed Jun. 13, 2001, the contents of which is hereby incorporated by reference in its entirety.

BACKGROUND OF INVENTION

1. Field of the Invention

The invention relates generally to the drilling of wells, such as those used for the production of oil and gas. More specifically, the invention relates to measuring downhole subsurface formation pressure.

2. Background Art

While drilling a borehole, the rock removed from the hole by the drill must be replaced with an equivalent weight to ensure stability of the formation. Drilling fluid, more commonly called drilling "mud," is used to compensate for the weight loss of the removed rock by providing a stabilizing pressure in the well hole and hold back formation fluid pressure. Because there is a generally linear relationship between the hydrostatic pressure and the vertical depth of a column of fluid, the stabilizing pressure of the mud can be easily controlled by varying the density of the mud.

It is desirable to maintain the mud pressure at a level slightly higher than the the formation pressure to avoid problems in well development. If the mud weight is much greater than the formation pressure, a condition called mud over-balance occurs, and the mud will deeply invade into the formation. Such deep invasion can reduce the production capabilities of a well and could completely block any passage of fluid into the well from the formation. If the overbalance is great enough, you can fracture the well, causing 'lost circulation.' Conversely, if the mud weight is under-balanced, where the formation pressure is greater than the mud pressure, the well is susceptible to a blowout, resulting in an uncontrollable and unrecoverable loss of material from the well. If the formation pressure is known during an early stage of development, the well can be developed in such a way as to optimize well production.

Further, when the mud is over-balanced, the mud in the borehole will form a highly concentrated layer of solids at the borehole wall interface of the formation. This layer is called the "mud cake." The thickness of the mud cake depends on, among other factors, the differential pressure between the formation and the borehole. By balancing the mud pressure with the formation pressure, the mud cake layer thickness is optimized, thereby reducing the chance that any well servicing or drilling tools will become stuck within the well.

FIG. 1A shows a top view of a borehole 11. When borehole 11 is filled with mud, the mud will form a mud cake layer 13. In a mud over-balanced situation, mud pressure is so high that mud will invade the formation 12, causing a skin-damage zone 14. In the skin-damage zone 14, the formation properties, including pressure, permeability, and porosity, are affected by the invading mud. FIG. 1B shows the same situation from a side view.

Methods for measuring formation pressure known in the art include removing the drill-pipe ("tripping the well") so that measuring instruments can be lowered into the open borehole. After these measurements are made, the drill-pipe is reinserted into the borehole so that drilling operations can continue. Because tripping the well in this manner is usually not done solely to allow for downhole measurements, formation pressure is not typically measured unless the drill-pipe is removed for another reason.

One technique for measuring formation pressure is called the draw-down or pre-test method. In this method, a formation tester tool is sent downhole to measure the formation pressure. The formation tester tool includes a donut-shaped rubber packer that is pushed against the borehole wall in order to isolate a small area of the formation face from the borehole pressure. Once in place, a hydraulically powered piston is moved within a test chamber in the tool, until the pressure in the small isolated area is significantly below the formation pressure. This pressure differential causes fluid to flow from the formation into the chamber. Over time, the pressure in the tool will stabilize to the formation pressure.

The pre-test method has several limitations. First, in low permeability formations, it can take several days for the pressure in the tool to converge to the formation pressure. Having the tool downhole for such an extended period of time can lead to tool sticking, making it difficult to remove the tool from the borehole. Also, large pressure imbalances can lead to packer failure and can tend to plug the tool with formation solids. Another problem is that the pre-test method uses large, heavy tools that require supplying hydraulic power to the tool while it is downhole. Finally, because of high stresses across the packer, the pre-test method does not work well in unconsolidated formations.

Another method for measuring formation pressure is described in U.S. Pat. No. 6,164,126, which is assigned to the assignee of the present invention. A probe is extended from a downhole tool into the formation. The probe extends through the mud cake and penetrates into the formation. Because the probe has a tapered shape, it creates a seal between the probe and the mud cake, and a packer is not required. The probe must penetrate the formation to a sufficient depth from the borehole so that it senses the formation pressure without substantial interference from the borehole fluids, that is, past the skin-damage zone. Unlike the pre-test, there is typically no pressure draw-down.

While the probe method overcomes some of the limitations of the pre-test method, it still has some limitations of its own. First, the probe must generally penetrate the formation past the skin-damage zone. By doing so, the probe itself may affect the pressure of the formation. When the probe is inserted, the displacement may cause the formation pressure to increase in the area of the probe. It is difficult to predict the amount of pressure increase because it will vary with the formation porosity and permeability. This increase typically diffuses or dissipates over time. Finally, when the probe is removed, it can leave a hole in the mud cake and the formation. This can allow the mud to invade the formation by flowing into the hole.

Recent advances in drilling fluid performance have made it possible to develop a well with substantially zero skin zone. A formation with no skin zone allows for the possibility of measuring the formation pressure with minimal penetration of a probe or sensor into the formation.

Another problem faced by previous devices is clogging. Typically, an opening in a probe may be blocked by rock particles from the formation, or completely covered by rock particles thereby sealing the opening and preventing a valid pressure measurement.

There remains a need to further develop techniques for evaluating formation properties. To this end, the present invention seeks to develop improvements in the testing process.

SUMMARY OF INVENTION

One aspect of the invention is a formation testing tool with a nozzle included therein. The nozzle is adapted to be moved between a retracted position and an extended position. In the extended position, the nozzle penetrates the mud cake and comes into pressure communication with the formation. In the extended position, the nozzle extends through the mud cake layer, creating a seal between the mud cake layer and a sealing surface on the exterior of the nozzle. A pressure sensor is operatively connected to the nozzle. Another aspect of the invention is a formation testing tool positionable in a wellbore having a sidewall. The tool comprises a nozzle and a tip. The nozzle is extendable from the tool into a mudcake layer lining the sidewall of the wellbore. The nozzle has a duct therethrough in pressure communication with a pressure sensor in the tool, and defines an outer surface adapted to sealingly engage the mudcake. The tip is at an end of the nozzle. The tip is adapted to restrict access to the duct whereby mudcake particles are prevented from entering the duct during formation testing.

Another aspect of the invention is a method for measuring formation pressure. The method according to the invention includes lowering the formation testing tool to a desired measuring position. The nozzle is then extended from the retracted position to the extended position, so that it penetrates the mud cake to the formation wall (rock face) in the borehole and the nozzle forms a seal with the mud cake. The formation pressure is communicated via an orifice in the tip of the nozzle, through the nozzle, and to a pressure sensor operatively connected to the nozzle.

Another aspect of the invention is a formation testing tool including a tool body adapted for movement through a wellbore. An actuator is disposed in the tool body and adapted to move a nozzle from a retracted position to an extended position. A nozzle in the extended position penetrates through a mud cake layer by an amount necessary to expose a tip of the nozzle to formation pressure. A tip is provided in an axial end of the nozzle. The tip has pores with a diameter smaller than a particle size in the mud cake layer. The nozzle having a passage therethrough in pressure communication with a pressure sensor in the tool. The passage is opened upon positioning of the nozzle tip. Another aspect of the invention relates to a method of testing a formation by lowering a formation testing tool to a first selected measuring position in a borehole, extending a nozzle through a mud cake layer on the sidewall of the borehole to form a seal between the mud cake layer and a sealing surface of the nozzle, positioning the tip of the nozzle to expose a passage in the nozzle to the formation pressure, and communicating the formation pressure through the nozzle to a pressure sensor. The nozzle has a tip at an end thereof and a passage therethrough. The tip may be porous or retractable to restrict access to the passage.

Other aspects and advantages of the invention will be apparent from the following description and the appended claims.

DETAILED DESCRIPTION

Figure 2:
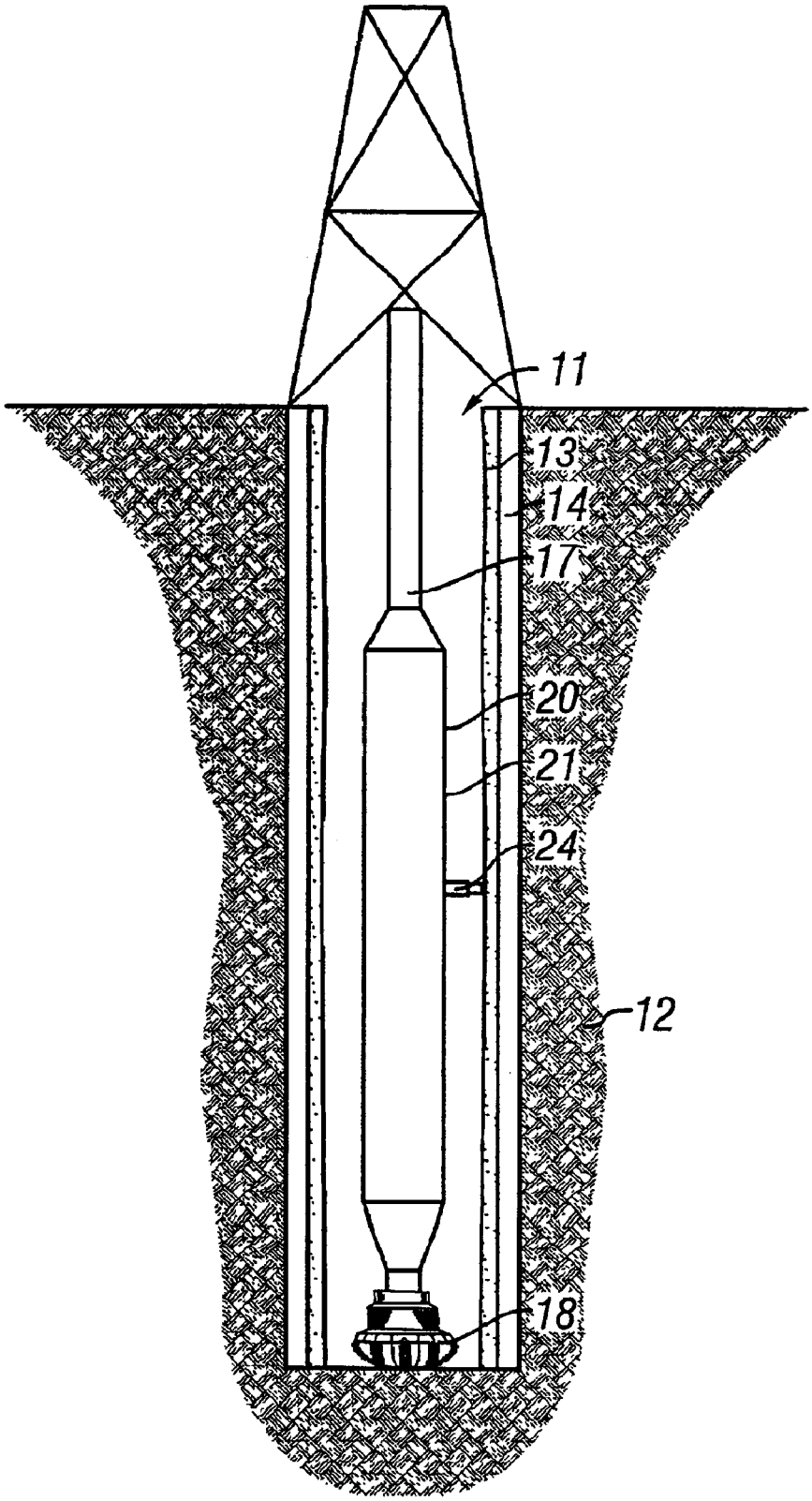
FIG. 2 is a cross-section diagram of a testing tool positioned in a borehole with a nozzle according to an embodiment of the present invention.

FIG. 2 shows an embodiment of a formation testing tool according to the invention. The testing tool 20 in this embodiment includes a tool body 21 adapted to be lowered into a borehole 11 as part of a drill string. The drill string includes drill pipe 17 and a drill bit 18 used to penetrate earth formations. The tool 20 contains a nozzle 24 disposed on an actuator (not shown in FIG. 3) adapted to extend from the body 21 of the tool 20 so that the nozzle 24 penetrates a mud cake layer 13 built up on the wall of the formation 12 and comes into pressure communication with the pore fluid within the formation 12. The nozzle 24 is shown in the extended position in FIG. 2.

While FIG. 2 depicts a drill string, it will be appreciated that the tool may be any variety of downhole tool, such as a wireline tool.

Figure 3:
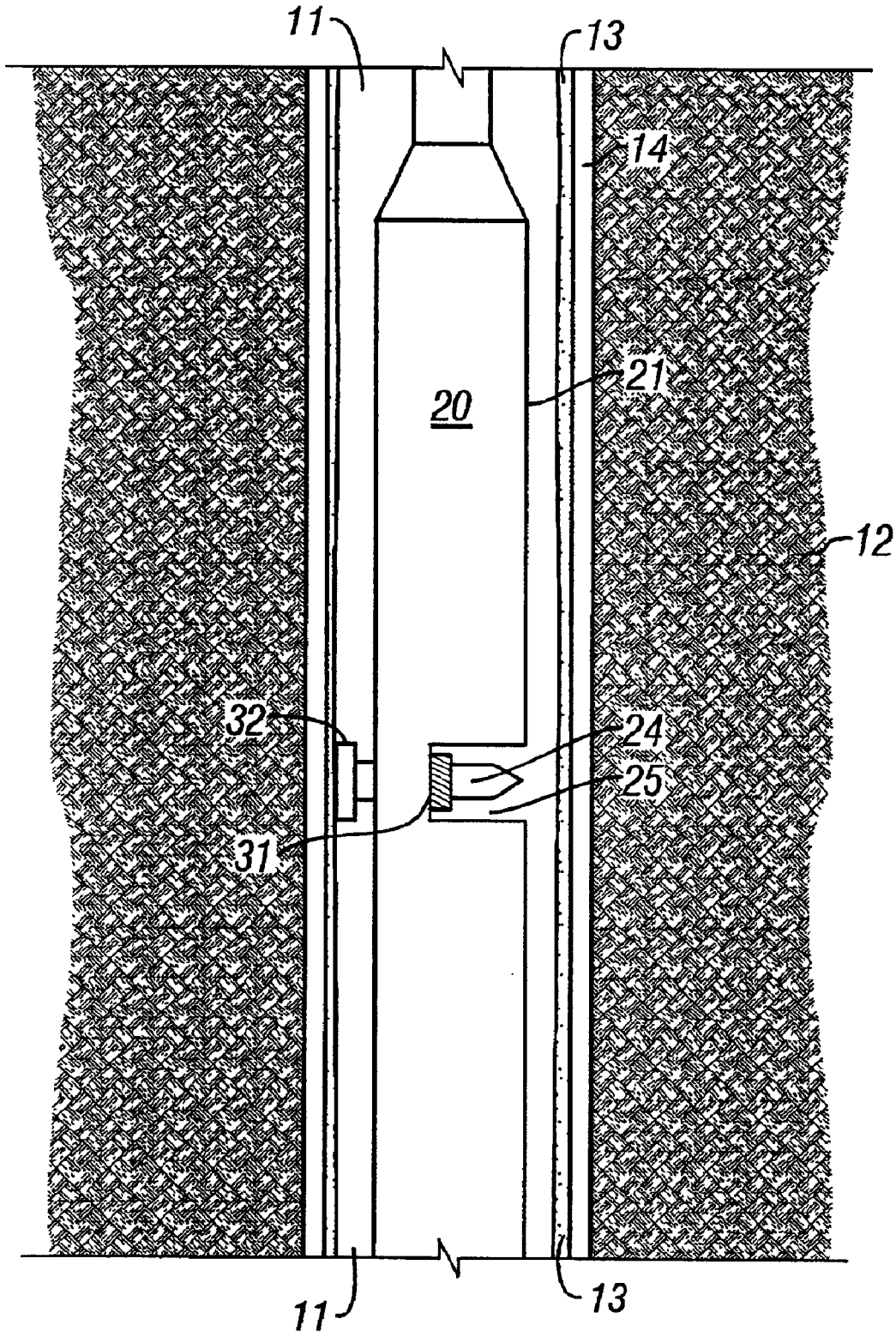
FIG. 3 is schematic drawing of the nozzle in a retracted position in the well logging tool.

FIG. 3 shows the nozzle 24 in a retracted position, preferably retracted into a recess 25 in the body 21 of the tool 20 so that the tool 20 may be moved through the wellbore 11 and rotated without damaging the nozzle 24. The tool 20 in this embodiment also includes a backup pad 32. The backup pad 32 is adapted to urge the body 25 of the tool 20 laterally in the wellbore to minimize the distance the nozzle 24 needs to be extended in order to contact the formation 32. Many such means for urging a well logging tool in a borehole are known in the art. U.S. Pat. No. 5,230,244 discloses a suitable example of a backup pad and actuator therefor.

At the base of nozzle 24 is the actuator 31. The actuator 31 moves the nozzle 24 from the retracted position to the extended position, so that the nozzle 24 penetrates the mud cake layer 13 and contacts the formation 12. Many actuators are known in the art which can be used in various embodiments of the present invention. One such actuator is shown in U.S. Pat. No. 6,164,126.

Figure 4:
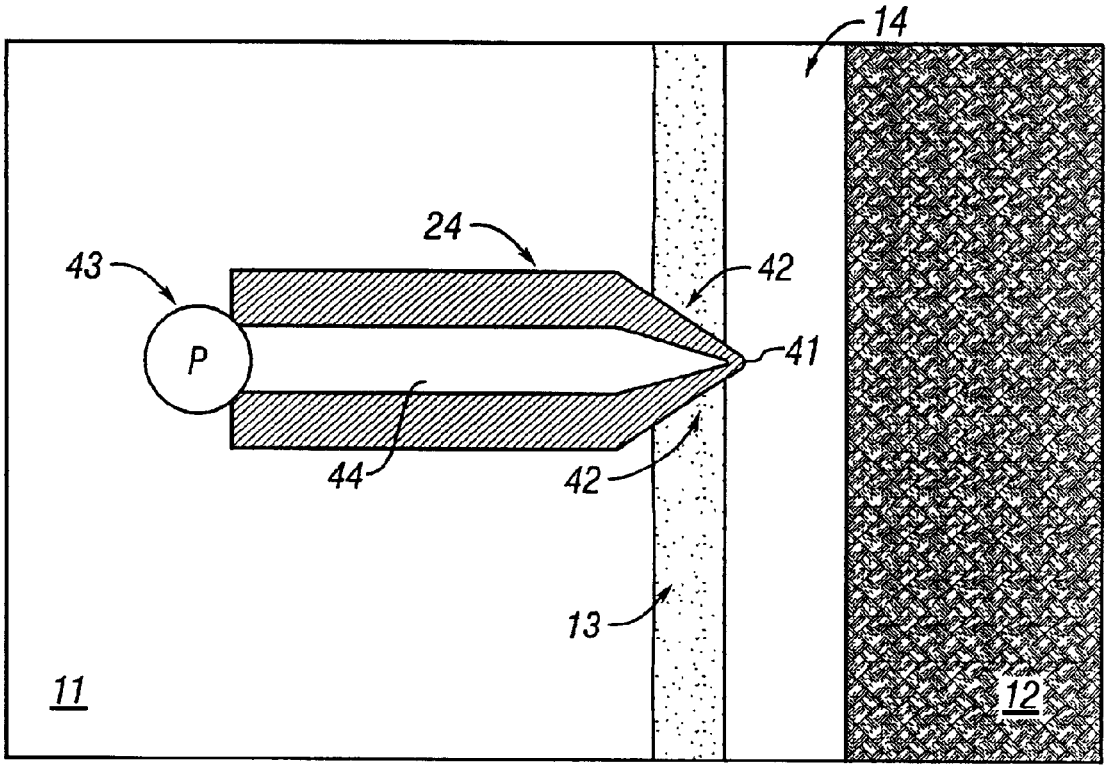
FIG. 4 is a cross-section of an embodiment of the nozzle having a porous tip penetrating the mud cake, the porous tip extending into the invaded zone to measure formation pressure.

FIG. 4 shows an embodiment of the nozzle 24 in the extended position. The nozzle 24 in the embodiment of FIG. 4 has a tip 41 at an end thereof. As shown in FIG. 4, the tip 41 is a porous tip extending from the end of the nozzle. Preferably, the porous tip 41 extends through the mud cake layer 13 and into the invaded zone 14 during testing. The dimensions of the porous tip 41 should be selected based on the drilling fluid properties. Preferably the porous tip 41 has one or more pores or holes therein, each hole having a diameter as large as possible while still being smaller than the size of the particles in the mud cake layer 13. If the holes of the porous tip 41 are smaller than the mud cake layer particle size, the porous tip 41 can penetrate the mud cake layer 13 without being clogged by particles in the mud cake layer 13. The porous tip 41 is at the end of a pressure communication duct or passage 44 in the nozzle 24 extending axially therealong. Preferably, the passage 44 occupies as small a volume as possible, consistent with the need to communicate pressure at the porous tip quickly.

The nozzle 24 has a circumferential sealing surface 42 that forms a seal with the mud cake layer 13. The diameter of the sealing surface 42 diverges away from porous tip 41, so that it will ultimately have a large enough diameter to form an effective seal with the mud cake 31. Should a 'leak' occur, the mud will flow leaving a cake which will form a seal and stop the leak. As the nozzle 24 is pushed through the mud cake layer 13, the sealing surface 42 seals against the mud cake layer 13. This isolates the porous tip 41 from the hydrostatic pressure of the drilling fluid in the borehole 11. By isolating the porous tip 41 from the borehole 11, the porous tip 41 will be exposed only to the fluid pressure in the formation 12.

The nozzle 24 is ultimately in pressure communication with a pressure sensor 43 through the passage 44. Once the nozzle 24 is in the extended position and a seal is formed between the sealing surface 42 and the mud cake 13, the fluid pressure in the formation 12 is communicated through nozzle 24 to pressure sensor 43. Any excess pressure in the nozzle 24 from the drilling fluid prior to extension of the nozzle 24 will be quickly dissipated in the formation 12 because of the relatively small volume in the nozzle 24, the passage 44 and the pressure sensor 43. There are many pressure sensors known in the art that may be used with any embodiment of the present invention. One such sensor is of a type described in U.S. patent application Ser. No. 09/091,446, assigned to the assignee of the present invention.

Figure 1A:
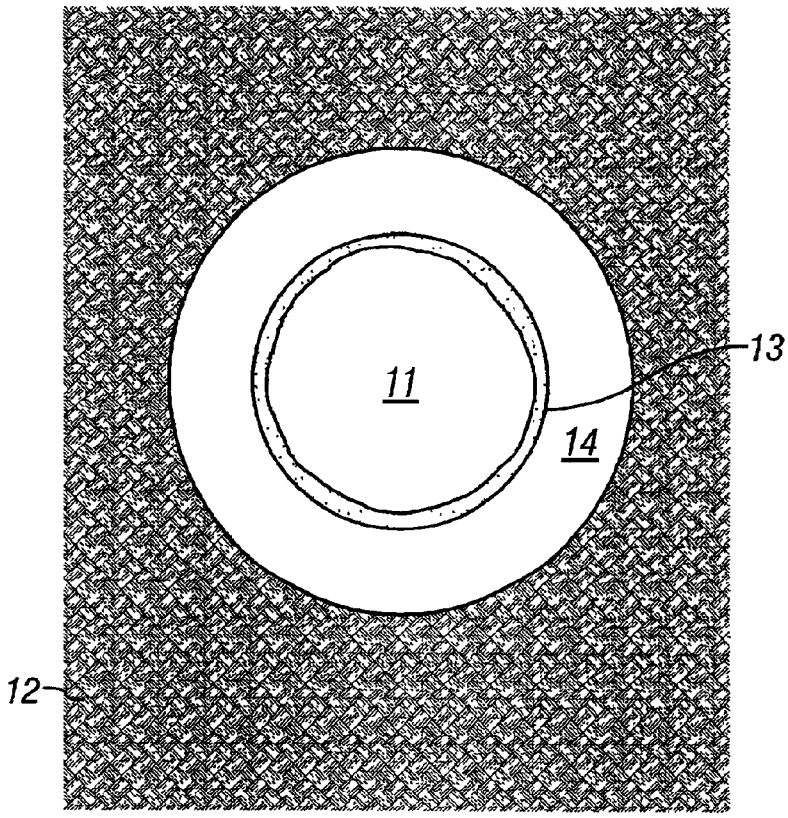
FIG. 1A (Prior Art)
FIGS. 1A and 1B are top view and a side view of a borehole in a formation where the invasion of drilling fluid has caused a skin-damage zone.
Figure 1B:
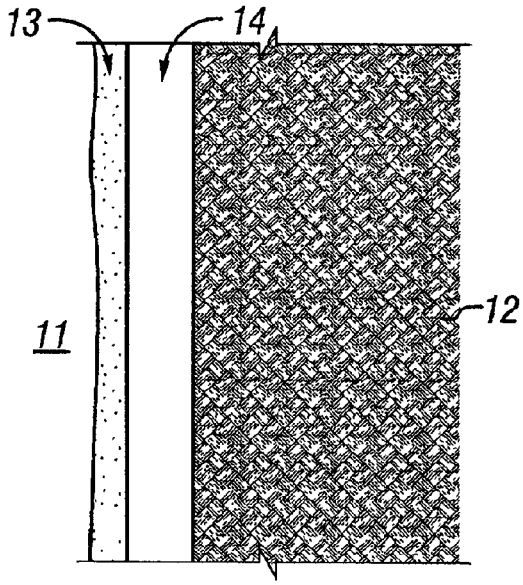
FIG. 1B (Prior Art)
Figure 6:
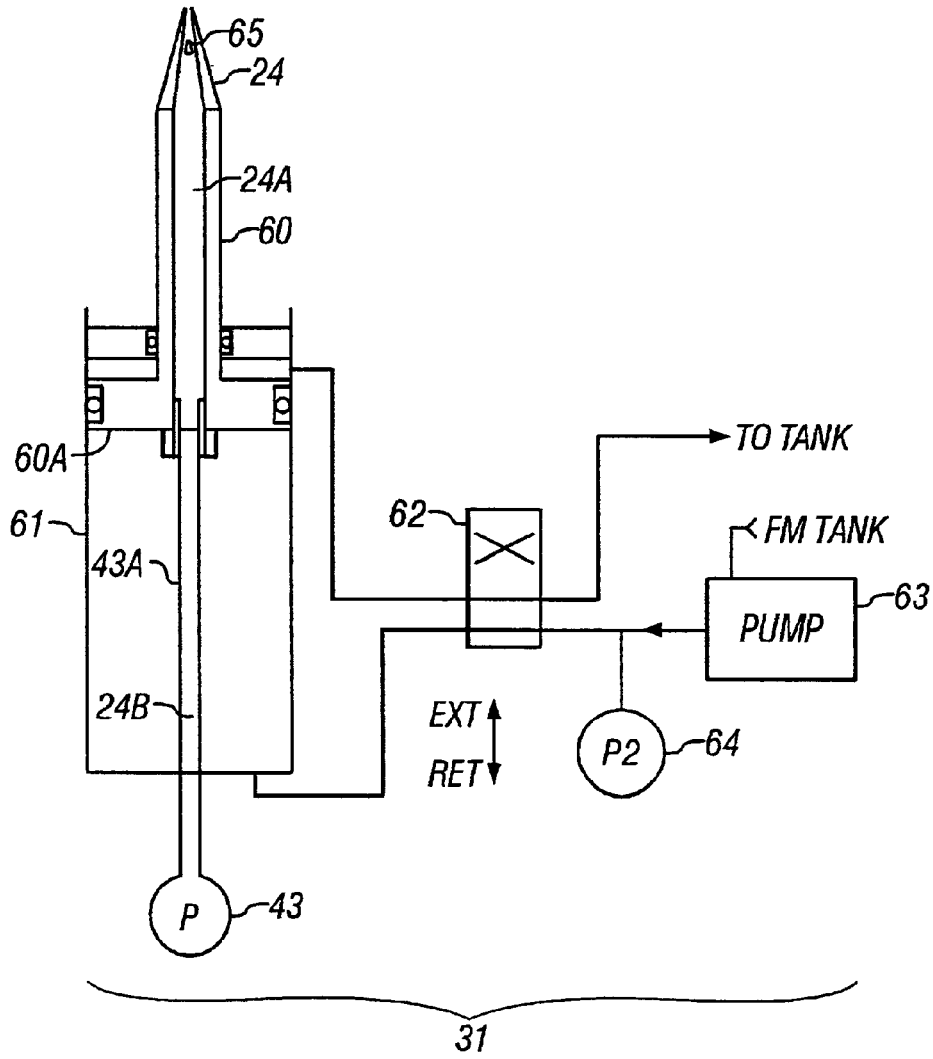
FIG. 6 shows an alternate embodiment of the nozzle and an actuator for extending and retracting the nozzle.

An embodiment of the actuator 31, and another embodiment of the nozzle 24 with a plug mechanism are shown in more detail in FIG. 6. The nozzle 24 is coupled to a ram 60 and piston 60A. The piston 60A sealingly slides in the bore of an hydraulic cylinder 61 (disposed in the body of the testing tool 20 in FIG. 2.) Hydraulic pressure from a pump 63 is directed to one side or the other of the piston 60A through a selector valve 62, depending on whether the piston 60A is to be extended or retracted from the cylinder 61. The side of the piston 60A not exposed to the pump pressure is vented to a supply tank (not shown). Pressure of the pump output may be measured by a second pressure sensor 64. Extension of the nozzle 24 to the point of contacting the formation (12 in FIG. 1) can be determined by observing an increase in pressure of the pump output. Similarly, full retraction of the piston 60A can be determined by observing an increase in the pump output pressure.

A central duct or bore 24A in the nozzle 24 can be slidably, sealingly engaged to a tube 24B in hydraulic communication with the pressure sensor 43. This structure is equivalent to the channel 44 shown in FIG. 4 and enables the nozzle 24 to be in hydraulic communication with the pressure sensor 43 at any amount of extension.

The nozzle 24 in this embodiment includes a retractable tip 65 which is movable between an extended and retracted position. The tip 65 is adapted to plug the end of the nozzle 24 during extension thereof (FIG. 7), and can be retracted to unplug the nozzle 24 (FIG. 6). The retractable tip 65 enables the nozzle 24 to penetrate the mud cake layer (13 in FIG. 1) in the extended or plugged position to prevent movement of particles into the nozzle and clogging the bore 24A. Once in the desire position, the retractable tip may be moved to the retracted or unplugged position so that the bore 24A is exposed to fluid pressure in the formation.

Figure 7:
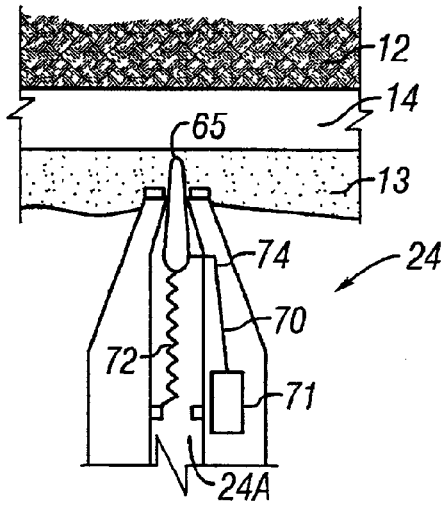
FIG. 7 shows an alternate embodiment of a nozzle with a retractable tip therein for restricting the flow of fluid into the nozzle.

An embodiment of the nozzle having a plug mechanism is shown in FIG. 7. The plug mechanism in this embodiment includes a solenoid 71 having a flexible coupling 70 operatively coupled at one end to the solenoid 71. The other end of the flexible coupling is in contact with a lock pin 74. In the absence of any axial force on the tip 65, the retractable tip 65 is urged to the plugged position (extended) by a spring 72 disposed in the passage (bore 24A), and seals the passage. The solenoid 71 can then be operated to extend the flexible coupling 70 to move the lock pin 74 so that it axially restrains the tip 65 in the plugged position.

When the actuator (31 in FIG. 3) is extended, the lock pin 74 thus holds the retractable tip 65 in the nozzle end. This enables the nozzle 24 to penetrate the mud cake layer 13 in the plugged position. In this embodiment, the nozzle and the retractable tip preferably penetrate the mud cake 13 without penetrating the invaded zone 14 as shown. After the actuator 31 is extended (as may be determined by monitoring pressure as measured by the second pressure sensor shown in FIG. 6), the solenoid 71 is then operated to retract the lock pin 74. This enables the retractable tip 65 to withdraw into the bore 24A so that the passage 24A is opened to fluid pressure in the formation (12 in FIG. 1), and ultimately, to the pressure sensor (43 in FIG. 4).

In one embodiment of a method according to invention, the formation pressure is measured during a drilling operation. Based on the measured formation pressure, the density of the drilling fluid can be adjusted so that the hydrostatic pressure in the borehole is at a selected over balance, under balance or is in balance with the fluid pressure in the formation. Balancing the borehole pressure accomplishes at least two important functions. First, balancing makes drilling more efficient by preventing the invasion and clogging of the formation that results from drilling fluid over balance. Second, balancing makes drilling safer by substantially reducing the risk of a blowout that resulting from drilling fluid under-balance.

While the plug mechanism of FIGS. 6 and 7 depict a retractable tip 65 with a lock pin 74, it will be appreciated that other plug mechanisms may also be incorporated to operatively retract the tip 65 as described herein. For example, a retractable spring mechanism, such as those commonly used with ball point pens, may be utilized to extend and retract the retractable tip.

The formation testing tool may be provided with multiple nozzles, either connected to one pressure sensor or separate pressure sensors. The use of multiple nozzles would increasing the possibility of getting a valid pressure measurement and allow for cross checking of pressures across the nozzles. The nozzles could be arranged on a pad in some order, or dispersed about the tool.

Figure 5:
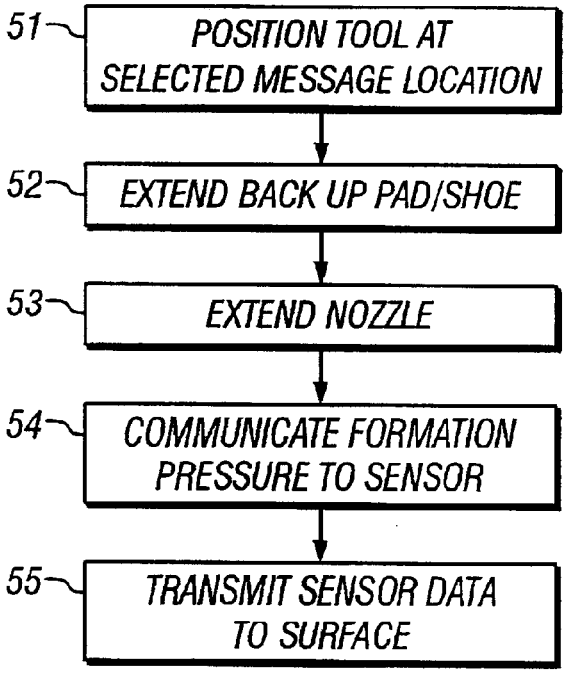
FIG. 5 is a flow chart showing an embodiment of a method according to the invention.

An embodiment of a method according to the invention is shown in the flow chart in FIG. 5. First, at 51, a formation testing tool is lowered to a desired position in a borehole. The operator lowers the tool until it is located at the depth where a measurement of the formation pressure is needed. Next, at 52, the logging tool is stabilized in the borehole. This can be accomplished by extending one or more support shoes, or backup shoes, such that they press against the wellbore wall. The support shoes stabilize the tool from any lateral movement while the nozzle is penetrating the mud cake and the formation.

At 53, the nozzle is extended from the retracted position to the extended position. In the retracted position (shown in FIG. 3), the nozzle is contained within the receptacle in the body of the tool. The actuator extends the nozzle to the extended position. As it is being extended, the nozzle penetrates the mud cake layer, forming a seal between the mud cake layer and the sealing surface of the nozzle.

The nozzle, as previously described, may contain a porous tip. The porous tip penetrates through the mud cake layer and to the invaded zone where it is exposed to the formation pressure. In an alternate embodiment, the nozzle contains a retractable tip extended from and retracted into the nozzle for selectively plugging a bore in the nozzle. With the retractable tip embodiment, the nozzle and retractable tip penetrate through the mud cake layer, but preferably not so far that the invaded zone is penetrated.

By limiting the exposed tip to the formation pressure, the nozzle does not substantially affect the formation pressure. The seal created between the nozzle and the mud cake layer isolates the tip so that it is exposed to the formation pressure free from any effects from the borehole pressure. Thus, by creating a seal with the mud cake and only penetrating the minimum necessary distance, the nozzle of the present invention can make an accurate measurement of the formation pressure.

Next, the formation pressure is communicated to a pressure sensor operatively connected to the nozzle. In one embodiment, the formation pressure data is transmitted to the earth's surface by any means known in the art, such as mud pulse telemetry. At the surface, the pressure data can be analyzed and the density of the mud adjusted so that borehole pressure balanced with formation pressure. The tip may then be retracted. Should oil release from the tip, it may be desirable to replenish after retracting.

The process described with respect to FIG. 5 can be repeated at different selected depths by retracting the nozzle and moving the tool to a different selected measuring position in the borehole. Where more than one nozzle is used for a single tool, the same operation may be repeated for each nozzle. As many measurements as needed may be performed while the tool is in the borehole without the need to remove the tool therefrom.

All of elements 51 through 55 can be performed by a tool that is included as part of a drill-string. By performing the method using a tool forming part of a drill string, formation pressure can be measured without having to remove the drill string from the borehole, thereby saving the time required to trip the drill string out of the well. Further, with the method being performed during a drilling operation, the borehole hydrostatic pressure (mud weight) can be adjusted to a balanced level without the need to trip the drill string to measure the formation pressure. It should be clearly understood, however, that while the embodiments of the invention described herein are intended to be included as part of a drill string, the method can also be performed at a time when the drill string is not in the borehole. Other embodiments of a testing tool according to the invention may therefore be adapted to be lowered into the borehole conveyed on a wireline or slickline.

Embodiments of the invention provide a method and instrument for making rapid pressure measurement of pressure of earth formations without the need to perform draw down procedures, or put a large-area packer or sealing element into contact with the wellbore wall. Embodiments of the invention may reduce the time needed obtain formation pressure measurements, and may reduce the risk of the tool becoming stuck in the borehole.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method for measuring a formation pressure, comprising:

lowering a formation testing tool to a first selected measuring position in a borehole;

extending a nozzle from the downhole tool and through a mud cake layer on a surface of the borehole, the nozzle having a tip extending therefrom, the tip adapted to selectively restrict access to a passage extending through the nozzle;

forming a seal between the mud cake layer and a sealing surface of the nozzle and exposing the passage of the nozzle to the formation pressure; and communicating the formation pressure through the nozzle to a pressure sensor.

2. The method of claim 1, further comprising:

transmitting pressure data generated by the pressure sensor to the earth's surface.

3. The method of claim 1, wherein the formation testing tool is included in a drill string.

4. The method of claim 3, wherein the method is performed during a drilling operation.

5. The method of claim 1, further comprising:

adjusting a density of a drilling fluid in response to a formation pressure determined by measurements made by the pressure sensor.

6. The method of claim 1 further comprising urging the formation testing tool toward a wall of the borehole on a same side thereof as the nozzle, the urging performed during or prior to extension of the nozzle.

7. The method as defined in claim 1 further comprising retracting the nozzle, moving the tool to a second selected measuring position, and repeating the extending, releasing and communicating.

8. The method of claim 1 wherein the tip is porous.

9. The method of claim 1 wherein the tip is retractable.

10. A formation testing tool positionable in a wellbore having a sidewall, comprising:

a nozzle extendable from the tool into a mudcake layer lining the sidewall of the wellbore, the nozzle having a duct therethrough in pressure communication with a pressure sensor in the tool, the nozzle defining an outer surface adapted to sealingly engage the mudcake; and a tip at an end of the nozzle and extending therefrom, the tip adapted to selectively restrict access to the duct whereby mudcake particles are prevented from entering the duct during formation testing.

11. The formation testing tool of claim 10 wherein the tip has a plurality of pores therethrough, the pores having a diameter smaller the particle size of the mudcake.

12. The formation testing tool of claim 10 wherein the tip is positioned in the duct at the end of the nozzle, the lip movable between an extended and retracted position for selectively restricting entry into the duct.

13. The formation testing tool of claim 12 further comprising an actuator for extending and retracting the tip.

14. The formation testing tool of claim 13 further comprising a lock pin for securing the tip in position.

15. The formation testing tool of claim 10, further comprising a telemetry unit adapted to transmit data from the sensor to the earth's surface.

16. The formation testing tool of claim 10, wherein the testing tool is adapted to be coupled to a drill-string.

17. A formation testing tool, comprising:

a tool body adapted for movement through a wellbore;

an actuator disposed in the tool body, the actuator coupled to a nozzle, the actuator adapted to move the nozzle between a retracted position and an extended position; and a nozzle tip disposed at an end of the nozzle and extending therefrom, the tip coupled to a lock adapted to maintain the tip in the end of the nozzle during extension of the actuator, the lock adapted to release the tip after extension the actuator, the nozzle having a duct there through in pressure communication with a pressure sensor in the tool, the duct opened upon release of the nozzle tip.

18. The formation testing tool of claim 17, wherein the nozzle comprises a sealing surface adapted to form a seal with a mud cake layer when the nozzle is in the extended position.

19. The formation testing tool of claim 17, further comprising a telemetry unit adapted to transmit data from the sensor to the earth'surface.

20. The formation testing tool of claim 17, wherein the testing tool is adapted to be coupled to a drill-string.

21. A formation testing tool, comprising:

a tool body adapted for movement through a wellbore;

an actuator disposed in the tool body and adapted to move a nozzle from a retracted position to an extend position, the nozzle in the extended position penetrating through a mud cake layer by an amount necessary to expose a tip of the nozzle to formation pressure; and a tip at an end of the nozzle and extending therefrom, the tip having pores with a diameter smaller than a particle size in the mud cake layer, the nozzle having a passage therethrough in pressure communication with a pressure sensor in the tool, the passage opened upon positioning of the nozzle tip.

22. The formation testing tool of claim 21, wherein the nozzle comprises a sealing surface adapted to form a seal with a mud cake layer when the nozzle is in the extended position.

23. The formation testing tool of claim 21, further comprising a telemetry unit adapted to transmit pressure data from the tool to the earth's surface.

24. The formation testing tool of claim 21, wherein the testing tool forms part of a drill-string.

25. A method for measuring a formation pressure, comprising:

lowering a formation testing tool to a first selected measuring position in a borehole;

extending a nozzle through a mud cake layer on the sidewall of the borehole to form a seal between the mud cake layer and a sealing surface of the nozzle, the nozzle having a tip at an end thereof extending therefrom and a passage therethrough, the tip adapted to selectively restrict access to the passage;

positioning the tip of the nozzle to expose a passage in the nozzle to the formation pressure; and communicating the formation pressure through the nozzle to a pressure sensor.

26. The method of claim 25 wherein the step of extending comprises extending a nozzle through a mud cake layer on the sidewall of the borehole to form a seal between the mud cake layer and a sealing surface of the nozzle, the nozzle having a porous tip at an end thereof and a passage therethrough, the tip having pores with diameters smaller than the particle size of the mudcake to prevent entry of mudcake particle into the passage.

27. The method of claim 26 wherein the step of positioning comprises positioning the porous tip of the nozzle into the invaded zone to expose a passage in the nozzle to the formation pressure.

28. The method of claim 25 wherein in the step of extending comprises extending a nozzle through a mud cake layer on the sidewall of the borehole to form a seal between the mud cake layer and a sealing surface of the nozzle, the nozzle having a retractable tip in an end thereof and a passage therethrough, the retractable tip movable between an extended and a retracted position for restrict access to the passage.

29. The method of claim 28 wherein the step of positioning comprises retracting the retractable tip of the nozzle to expose a passage in the nozzle to the formation pressure.

30. The method of claim 25, further comprising:

transmitting pressure data generated by the pressure sensor to the earth's surface.

31. The method of claim 25, wherein the formation testing tool is included in a drill string.

32. The method of claim 31, wherein the lowering, extending, and communicating are performed during a drilling operation.

33. The method of claim 25, further comprising:

adjusting a density of a drilling fluid in response to a formation pressure determined by measurements made by the press sensor.

34. The method of claim 25 further comprising urging the formation testing tool toward a wall of the borehole on a same side thereof as the nozzle, the urging performed during or prior to extension of the nozzle.

35. The method as defined in claim 25 further comprising retracting the nozzle, moving the tool to a second selected measuring position, and repeating the extending, releasing and communicating.

36. The method of claim 25 further comprising repeating the steps of extending positioning and communicating for each nozzle.

* * * * *